United States Patent [19]

Fockens

[11] Patent Number: 4,551,712

[45] Date of Patent: Nov. 5, 1985

[54] ELECTRONIC DETECTION SYSTEM FOR DETECTING A RESPONDER INCLUDING A FREQUENCY DIVIDER

[75] Inventor: Tallienco W. H. Fockens, Eibergen, Netherlands

[73] Assignee: N.V. Nederlandsche Apparatenfabriek Nedap, De Groenlo, Netherlands

[21] Appl. No.: 378,244

[22] Filed: May 14, 1982

[30] Foreign Application Priority Data

Jan. 14, 1982 [NL] Netherlands ..... 8200138

[51] Int. Cl.[4] ..... G08B 13/24

[52] U.S. Cl. ..... 340/572; 343/6.8 R

[58] Field of Search ..... 340/572; 343/6.8 R, 343/6.8 LC

[56] References Cited

U.S. PATENT DOCUMENTS

| | | | |
|---|---|---|---|
| 3,838,409 | 9/1974 | Minasy et al. | 340/572 |
| 3,859,652 | 1/1975 | Hall et al. | 343/6.8 R |
| 3,895,368 | 7/1975 | Gordon et al. . | |
| 3,964,024 | 6/1976 | Hutton et al. . | |
| 4,260,983 | 4/1981 | Falck et al. | 343/6.8 LC |
| 4,274,089 | 6/1981 | Giles | 340/572 |

FOREIGN PATENT DOCUMENTS

| | | |
|---|---|---|
| 0003178 | 1/1979 | European Pat. Off. . |
| 1813319 | 9/1969 | Fed. Rep. of Germany . |
| 2301135 | 12/1968 | France . |
| 7903841 | 5/1978 | Netherlands . |
| 1599120 | 5/1978 | United Kingdom . |

OTHER PUBLICATIONS

Dutch Search Report, Oct. 29, 1982 (Form PCT/ISA/201(a)07.1979).

*Primary Examiner*—Glen R. Swann, III

*Attorney, Agent, or Firm*—Fleit, Jacobson, Cohn & Price

[57] ABSTRACT

In an electronic detection system comprising a transmitter for generating an interrogation field, said transmitter being coupled with at least one transmitting antenna coil; a responder with a receiving coil and a transmitting coil for transmitting a signal in response to said interrogation field; and a receiver-and-detector coupled with at least one receiving antenna coil for receiving and further processing the signal transmitted by said responder; the improvement which consists in that said receiving coil and said transmitting coil of said responder are arranged in parallel to each other, and that said responder comprises a frequency divider connected between said receiving and transmitting coil and arranged to divide the signal frequency received by a factor N≧4.

20 Claims, 13 Drawing Figures

ELECTRONIC DETECTION SYSTEM FOR DETECTING A RESPONDER INCLUDING A FREQUENCY DIVIDER

BACKGROUND OF THE INVENTION

This invention relates to an electronic detection system. Such systems are much used in department stores to detect shoplifting. For this purpose the goods to be protected are provided with a detection plate or responder, which normally is removed at the cash desk. Furthermore, at the exits of the shop an electromagnetic field is generated, to which a responder carried through this field reacts. This reaction, which may be either principally energy absorption or principally energy transmission, can be detected, so that an indication can be obtained of the fact that merchandise still provided with a responder is carried through the field.

Such a system, which is based on energy absorption by the responder, is known, for example, from U.S. Pat. No. 3,500,373.

Generally speaking, such a system is suitable for detecting the passage of goods, animals or persons provided with a responder through a detection zone. If identification of the kind of goods, an animal or a person, is desirable, the reaction of the responder may be a coded signal.

Systems of the kind described are particularly suitable for use in detecting theft in shops. In such systems, a responder is attached to articles to be safe-guarded, which responder is removed at the cash desk upon payment. At the shop's exits, an interrogation zone is created so that, if goods still provided with a responder pass the interrogation zone, this can be detected.

The known anti-shop-lifting systems are all intended for safe-guarding large numbers of goods. This means that large numbers of responders are required. This in turn means that price of the responders must be low, which leads to a structurally and electrically simple responder, often just consisting of a resonance circuit embedded in a detection plate, or of a strip of magnetic material.

Owing to the simplicity of such responders, it is virtually inevitable that electrical processes similar to those occurring in the responder also occur in other articles which pass the interrogation zone. This may create a false alarm, which is highly undesirable. Spurious electrical and radio signals can also cause such false alarms.

It is true that the chance of false alarms can be reduced by special features in the transmitter generating the interrogation field and/or the receiver receiving the signals from the responder in a system based on transmission, but this is also accompanied by a reduction in detection sensitivity.

Accordingly, known systems still leave much to be desired either in the field of suppressing false alarm, or in the field of detection sensitivity.

This problem could be solved by using a more sophisticated responder in which an electronic process takes place, which does not occur "in nature". Such a responder would also be more expensive than conventional responders.

A higher cost price of the responders is acceptable, if the articles to be safe-guarded, too, are relatively valuable.

There is accordingly a need for a reliable system which is in particular suitable for use in shops in which goods with a relatively high value are displayed. Examples of such shops are radio and television shops, jewellers, expensive clothes boutiques, etc. Other uses are also possible.

SUMMARY OF THE INVENTION

It is an object of the invention to provide a system which satisfies the above requirements.

The invention accordingly provides, in an electronic detection system comprising a transmitter for generating an interrogation field, said transmitter being coupled with at least one transmitting antenna coil; a responder with a receiving coil and transmitting coil for transmitting a signal in response to said interrogation field; and a receiver-and-detector coupled with at least one receiving antenna coil for receiving and further processing the signal transmitted by said responder; the improvement which consists in that said receiving coil and said transmitting coil of said responder are arranged in parallel to each other and that said responder comprises a frequency divider connected between said receiving and transmitting coil and arranged to divide the signal frequency received by a factor $N \geqq 4$.

BRIEF DESCRIPTION OF THE DRAWINGS

Some embodiments of the invention will now be described with reference to the accompanying drawings, in which.

DETAILED DESCRIPTION

Figures 1, 2, 3A:
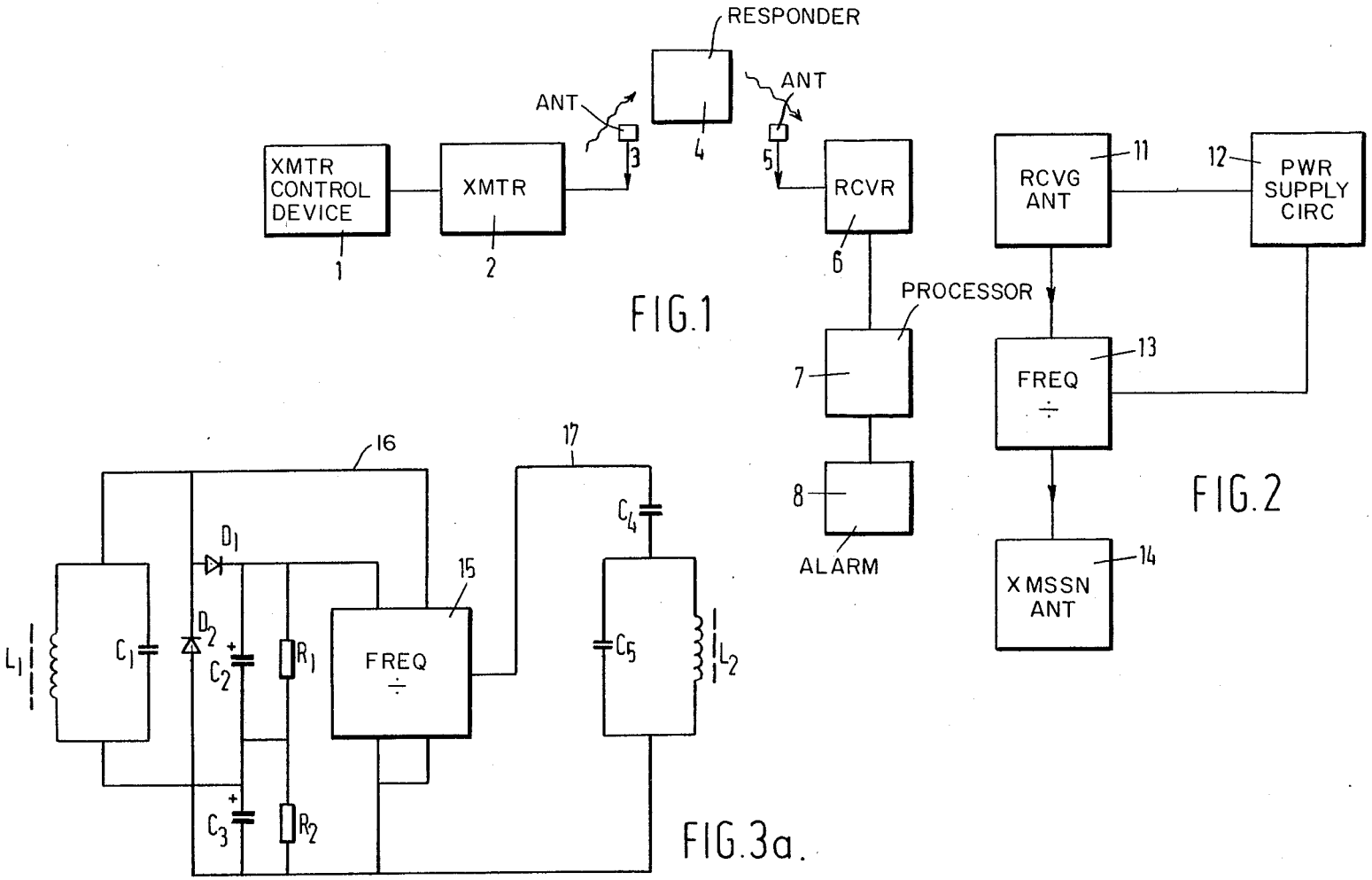
FIG. 1 shows diagrammatically a detection system based on transmission.
FIG. 2 shows diagrammatically a responder circuit according to the present invention.
FIG. 3*a* shows a wiring diagram of an example of a responder according to the present invention; according to the present invention.

FIG. 1 shows diagrammatically a detection system based on transmission, and comprising a transmitter-control device 1, and a transmitter 2 coupled to a transmitting antenna 3. When the device is energized, an electromagnetic field is generated in an interrogation zone via antenna 3. If a responder 4 is present in the interrogation zone, it reacts to the electromagnetic field by transmitting a signal which is received by an antenna 5 of a receiver 6. The signals received are processed by a processor 7 and, in the case of an anti-theft system, supplied to an alarm device 8.

In such systems it is of importance that the responder transmit a signal sufficiently unique that it can be recognized at the receiving end as originating unambiguously from the responder. The signal transmitted by the responder should also be capable of being distinguished at the receiving end from the signal transmitted by the transmitter via antenna 3.

FIG. 2 shows diagrammatically the basic scheme of a responder according to the invention. The responder comprises a receiving antenna 11, connected to a frequency divider 13, which divides the frequency of the signal received by a fixed number, and supplies the resulting signal to a transmission antenna 14.

The frequency divider 13 should be supplied with supply voltage, for which purpose a supply circuit 12 is provided in the arrangement of FIG. 2. The supply circuit 12 withdraws from the receiving antenna a portion of the energy received, and converts this into a DC voltage, which is supplied to the frequency divider 13 as a supply voltage. In this case the responder is referred to as a passive responder.

Instead of a supply circuit, a battery may be used. If a frequency divider 13 is built up by means of integrated circuits, e.g. made by the CMOS technique, only little supply energy is required, and in combination with a modern battery, a battery service life of approximately five years is possible.

The use of a frequency divider in a responder is known per se. In these known responders, the frequency received by the responder is divided by two and re-transmitted. Division by two has the disadvantage that the frequencies of the signals received and re-transmitted are relatively close together, as a result of which, in order to effect proper separation, the receiving coil and the transmitting coil of the responder should be placed at right angles to each other. This requires a relatively bulky responder.

According to one aspect of the present invention, this disadvantage is overcome by selecting a higher factor of division, which is minimally four, and in a preferred embodiment eight.

By virtue of the fact that, when a higher factor of division is used, and hence the frequency divider is somewhat more complicated, the frequencies received and re-transmitted by the responder are relatively far apart, the receiving and transmitting coils of the responder need not be at right angles to each other. The responder's receiving and transmitting coils may then be arranged in parallel, and even be placed jointly on a single ferrite rod, so that a highly compact construction of the responder is possible.

Furthermore, the risk of false alarm is less according as there are larger differences between the signal received by the responder and that re-transmitted by the responder.

The choice of a relatively high factor of division also has beneficial effects for the transmitter and the receiver of the system, which will be described hereinafter.

Figure 3B:
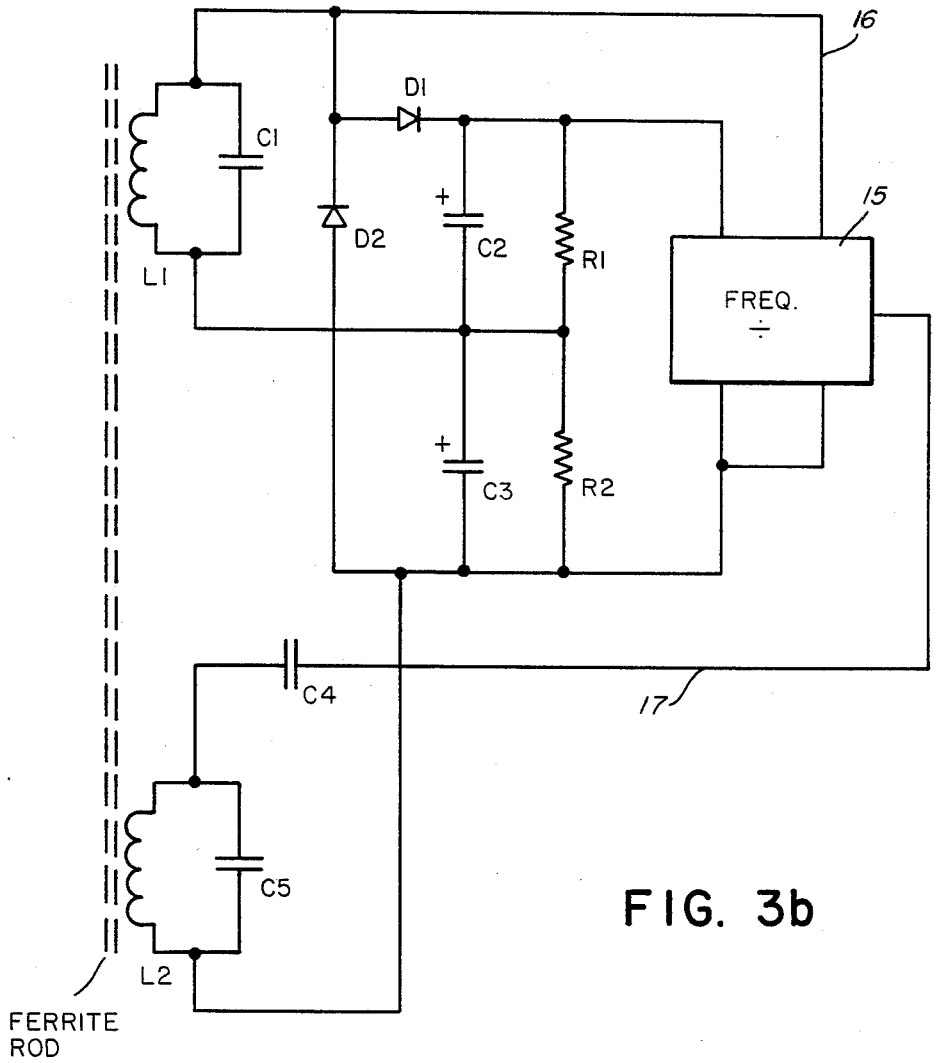
FIG. 3*b* shows the receiving and transmitting coil on a single ferrite rod utilizing the circuitry illustrated in FIG. 3*a*.

FIG. 3*a* and 3*b* shows the wiring diagram of an example of a responder according to the invention. The responder comprises a receiving circuit comprising a receiving coil $L_1$ and a capacitor $C_1$. Furthermore, the responder comprises a transmitting circuit comprising a transmitting coil $L_2$ and a capacitor $C_5$. In a practical embodiment, the receiving circuit is tuned to 138 kc, the transmitting circuit being tuned to 17.25 kc. As stated before, the receiving coil $L_1$ and the transmitting coil $L_2$ may be arranged parallel to each other, and even be mounted jointly on one single ferrite rod. See e.g. FIG. 3*b*.

From the fact that the receiving circuit $L_1C_1$ is tuned to 138 kc, with the transmitting circuit $L_2C_5$ being tuned to 17.25 kc, it is apparent that, in this embodiment, the frequency is divided in the responder by a factor eight. For this purpose an integrated binary frequency divider 15 is provided, which, for example, may be of the commercially available type HEF 4024 BP. This is an integrated circuit made by the CMOS technique, which absorbs little supply energy. The signal coming from the receiving circuit is supplied via a conductor 16 to the input of the divider 15. The signal of frequency 17.25 kc is supplied via a conductor 17 and a capacitor $C_4$ to the transmitting circuit $L_2C_5$ of the responder. The responder shown is of the passive type, i.e., the supply energy for divider 15 is withdrawn from the receiving circuit. For this purpose rectifiers $D_1$ and $D_2$ are provided, and smoothing capacitors $C_2$, $C_3$ and smoothing resistors $R_1$, $R_2$.

When a responder of the above-described type is used, detection of the responder signal can be realized in various ways.

Figures 4, 5:
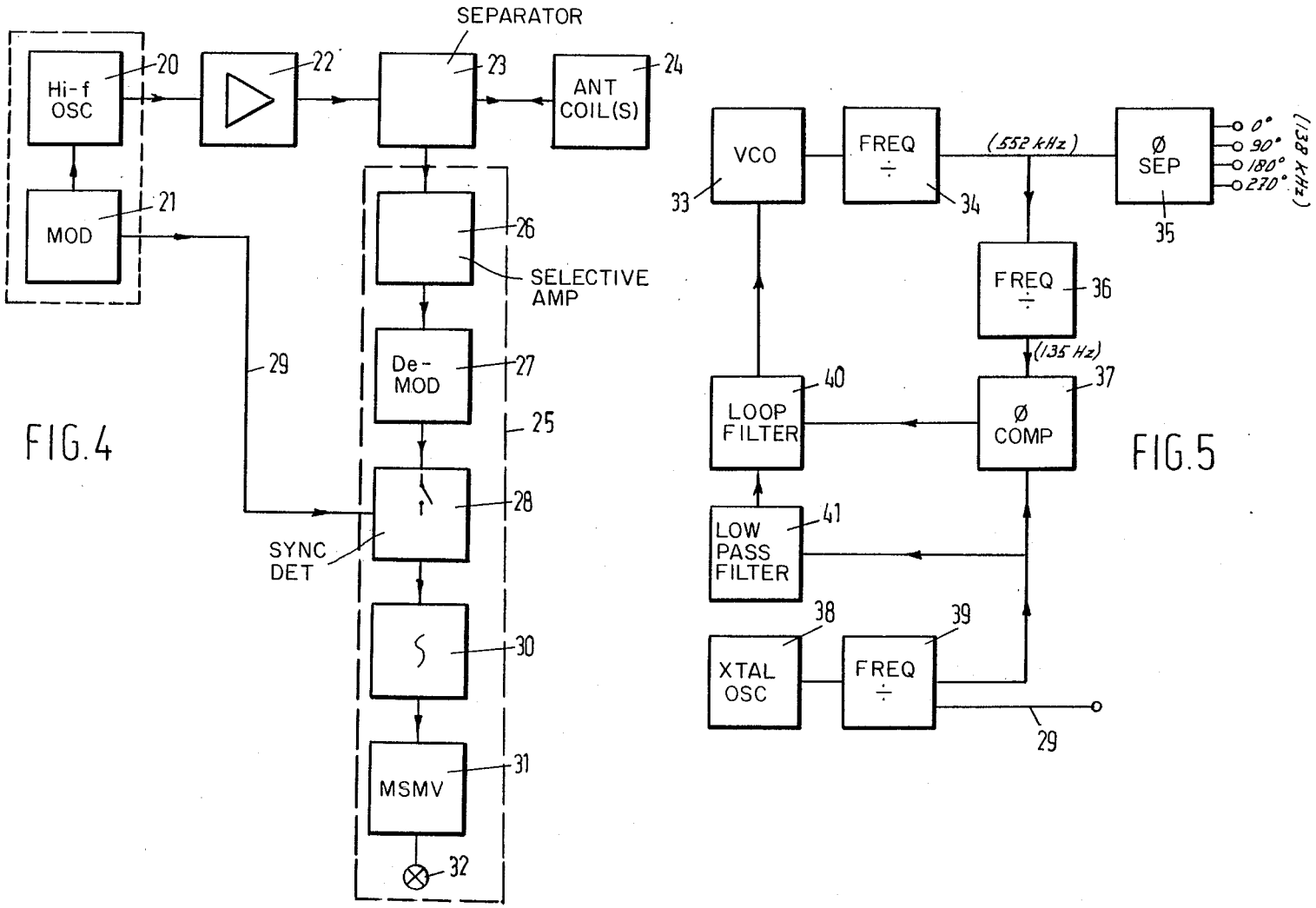
FIG. 4 shows a block diagram of a first variant of a system according to the invention.
FIG. 5 shows a block diagram of a detail of the system of FIG. 4.

A first method is embodied in the system shown in FIG. 4.

In the system shown in FIG. 4, use is made of the fact that the instantaneous frequency of the signal transmitted by transmitter 2 (FIG. 1) is equal to the instantaneous frequency of the signal which, in the presence of a responder in the interrogation zone, is received by receiver 6 (FIG. 1), divided by the factor of division N of the responder. This means that, if the signal transmitted is frequency-modulated, the signal received is also frequency-modulated, but the frequency discursion of the signal received is a factor N smaller than the frequency discursion of the signal transmitted. The presence of this frequency modulation can accordingly be detected in the receiver.

The system of FIG. 4 comprises a high-frequency oscillator 20 which provides the carrier wave for the interrogation signal to be transmitted. This signal is frequency-modulated with a sinusoidal signal by means of a modulating oscillator 21. In a practical embodiment, the carrier wave may again have a frequency of 138 kc, and the modulating signal a frequency of 135 cycles. The output signal from the high-frequency oscillator 20 is supplied via a power amplifier 22 and a separator 23 to one or more antenna coils 24. The separator 23 will be described in more detail hereinafter. It is here noted that the separator 23 serves to separate signals to be transmitted from the signals received. This is of importance because, preferably, a combined transmitter/-receiver coil or coils is (are) used.

The signal received by the combined transmitter/-receiver coil(s) 24 is accordingly supplied via separator 23 to a receiving and processing device 25. This comprises a selective amplifier 26, which is tuned to the frequency transmitted by the responder, and further filters and amplifies the response signal received. The output signal from the selective amplifier is demodulated in a demodulator 27. In the presence of a responder in the interrogation field, the signal with which the high frequency oscillator 20 was frequency-modulated is thus again generated at the output or demodulator 27. The output signal from the demodulator is supplied to a synchronous detector 28, to which is also supplied a reference signal, which comes from modulating oscillator 21 via line 29. The synchronous detector is so arranged that, if the signal received is in phase with the reference signal, and if additionally the signal-to-noise ratio is sufficiently high, it applies an output voltage to an integrator 30, which causes the output voltage of the integrator to increase.

As soon as the output voltage of the integrator 30 exceeds a threshold level, which is adjustable, and determined by level detector 31, the level detector 31 provides an output signal which energizes a signalling or alarm device 32.

FIG. 5 shows an example of a practical embodiment of a circuit for generating a frequency-modulated interrogation signal. The circuit shown in FIG. 5 corresponds to blocks 20 and 21 of FIG. 4. It should be noted that other circuit arrangements are possible, which provide a comparable result.

A voltage-controlled oscillator 33 generates a high-frequency signal, which is divided by a factor A by a divider 34 and by four by a phase separator 35 to the interrogation carrier wave frequency. In FIG. 5, the frequencies and divisors as may be used in a practical embodiment of the system are specified in brackets.

Divider 36 divides by a factor B, and its output signal is compared in phase comparator 37 with a stable signal from a crystal oscillator 38 and divider 39. The output signal from the phase comparator is passed via a loop filter 40 to oscillator 33, with which the phase lock loop (PLL) is locked. Accordingly, phase locking takes place, using the output signal from divider 39 as a reference. This reference signal, converted into a sinusoidal voltage of the same frequency in a low-pass filter 41, modulates oscillator 33 also in frequency. As this frequency-modulation takes place synchronously with the phase locking (the average of the frequency deviation is zero over one cycle of the reference signal), no disturbance of the phase lock loop is effected. Divider 39 also supplies the reference signal for the synchronous detector in the receiver.

Figure 12:
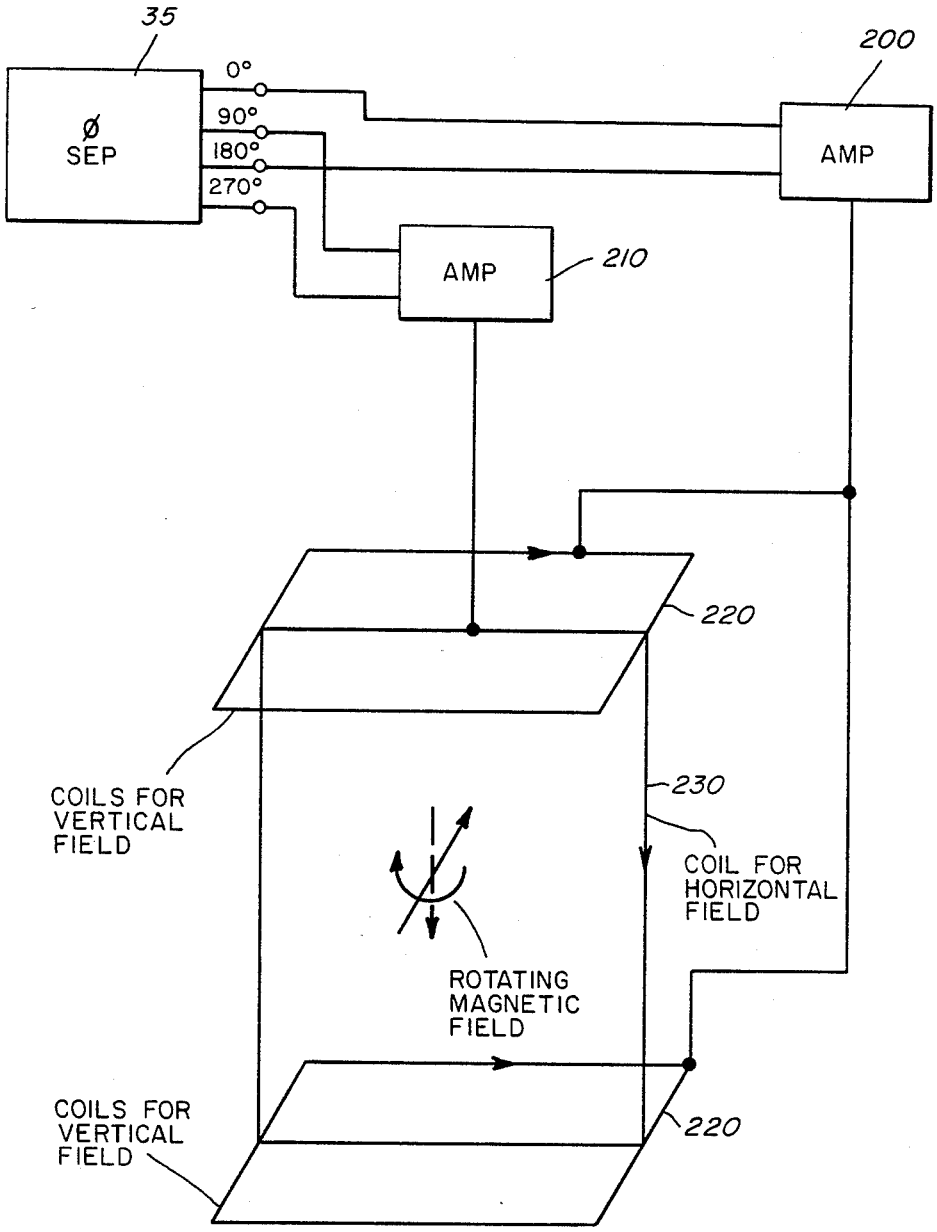
FIG. 12 shows the antenna configuration for a rotating magnetic field.

Phase separator 35 (see FIG. 12) has four output terminals, which each give a (symmetrical) block voltage with the frequency of the interrogation signal, and the phase of which increases by 90 degrees at each successive output. Thus there are two pairs of outputs differing 180 degrees in phase from each other. A first such pair of outputs controls a power amplifier 200 comprising two integrated amplifier circuits, and supplying an antenna coil 220 in a symmetrical way. The other pair can also control a power amplifier 210, but phase-shifted relative to the first amplifier by 90 degrees. If the second power amplifier supplies a second coil 230 placed perpendicularly to the first antenna coil 220, a rotary magnetic field is generated. Circuit 35 is further described with respect to FIG. 5.

Such a rotary magnetic field in the passageway of the detection system renders the alarm system less dependent on the position of the responder, and hence the chance of detection greater.

Figure 6:
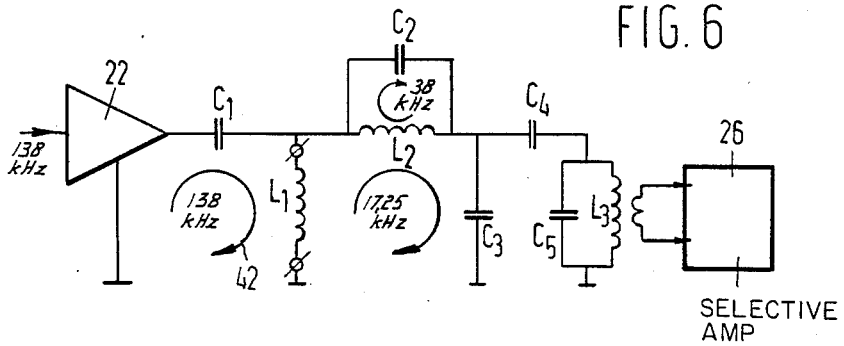
FIGS. 6 and 7 show two embodiments of an antenna circuit according to the invention.

FIG. 6 shows a practical embodiment of an antenna circuit for a system according to the invention. The figure correspond to blocks 22, 23, 24 and 26 of FIG. 4.

Power amplifier 22 energizes as a power source a series circuit $C_1$–$L_1$, which resonates at the transmission frequency of 138 kc. An A.C. current is generated as indicated by an arrow 42 and across the terminals of the transmission/receiving coil $L_1$, a 138 kc voltage with an amplitude of 100–200 Volt is generated.

The series circuit of $L_1+L_2$ and $C_3$ resonates at the receiving frequency of 17.25 kc. For this frequency, $C_1$ has a high impedance, so that the 17.25 kc current exclusively flows via $L_2$ and $C_3$ and induces a voltage across $C_3$.

The parallel circuit of $L_2$ and $C_2$ resonates at 138 kc and for that frequency forms a very high impedance. This prevents any 138 kc current from flowing to $C_3$.

In this way the (strong) 138 kc transmission signal is kept away from the receiver, while the reception signal (17.25 kc) picked up by $L_1$ goes to the receiver only.

$C_5$ and $L_3$ form a parallel circuit resonating at 17.25 kc, which via coupling capacitor $C_4$ is coupled to circuit $L_1+L_2$ and $C_3$, and whereby the signal received is further filtered and supplied via a coupling coil to the receiver.

Accordingly, in this circuit arrangement, coil $L_1$ is a combined transmitting and receiving antenna which is energized asymmetrically, as $L_1$ has one terminal grounded.

Figure 7:
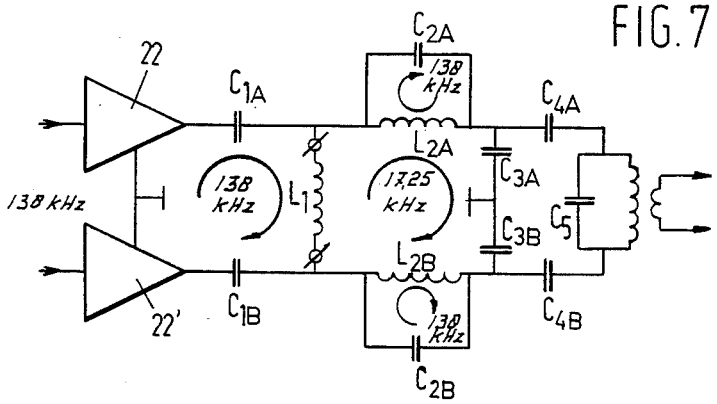

FIG. 7 gives the basic diagram for a symmetrical circuit arrangement. Two power amplifiers 22 and 22' are controlled with two 138 kc signals differing 180° in phase from each other.

$C_1A$, $L_1$ and $C_1B$ constitute the 138 kc transmitting circuit; $C_3A$, $L_2A+L_1+L_2B$, $C_3B$ form the 17.25 kc receiving circuit. For the rest the circuit is identical to that of FIG. 6. The circuit arrangement is symmetrical both with regard to the transmission signal and with regard to the reception signal. For the receiving end this has the additional advantage that spurious electrical fields and spurious voltages on the mains do not result in spurious signals in the receiver.

The circuits of FIGS. 6 and 7 are possible owing to the transmission and reception frequencies being wide apart, and render the use of critical duplex techniques superfluous.

Figure 8:
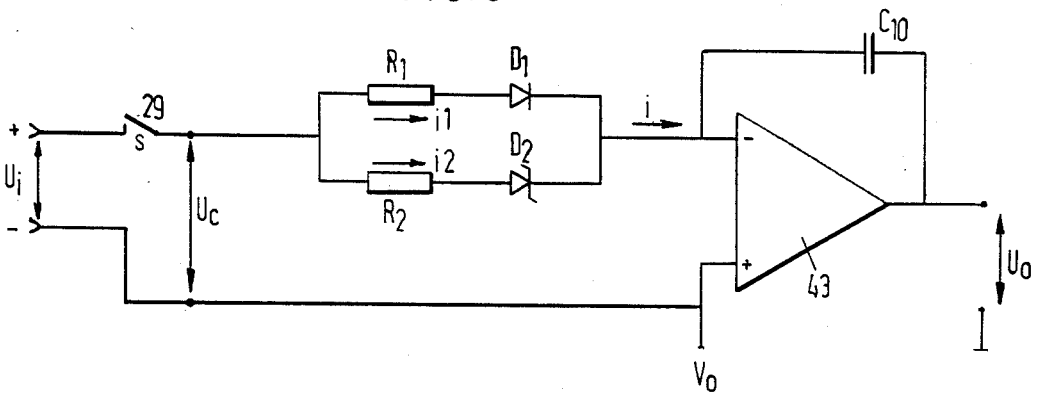
FIG. 8 shows a synchronous detection circuit according to the invention.

FIG. 8 shows a practical embodiment of a circuit for the synchronous detection of the modulation signal added to the transmitted signal by the modulating oscillator 21, which modulation signal may have a frequency of 135 c as indicated. The frequency discursion may be, e.g., 800 c. The circuit shown in FIG. 8 corresponds to blocks 28 and 30 of FIG. 4.

In this embodiment, again, the responder divides by eight, and accordingly has an output signal of a frequency or 17.25 kc with a frequency discursion of 100 c. The frequency of the modulation signal, however, is still 135 c.

In demodulator 27 (FIG. 4), the 135 c auxiliary carrier wave is recovered and supplied to the synchronous detection circuit 28 (see FIG. 4). S is the synchronous switch which via line 29 is controlled by the 135 c reference signal from the transmitters, and $R_1$, $R_2$, $D_1$ and $D_2$, constitute a detection threshold circuit.

The operation is as follows (also see the voltage curves in FIG. 9): $U_i$ is the 135 c auxiliary carrier wave received. During the negative part of the cycle, switch S closes for $\frac{1}{4}$ cycle and then $U_C=U_i$. The negative input of an operational amplifier 43 then has the same voltage as the positive input, i.e. $V_o$. The voltage drop across the detection threshold circuit is accordingly $U_C$.

The relation between current i through the detection threshold circuit (FIG. 8) and the integrator formed by operational amplifier 43 and capacitor $C_{10}$, and the voltage $U_C$, is given by:

for $U_C > U_{D1,2}$:

$$i = i1 + i2 = \frac{U_C - U_{D1}}{R1} + \frac{U_C - U_{D2}}{R2} \quad (1)$$

-continued $$\text{for } U_C < -U_Z: \quad i = \frac{U_C - (-U_Z)}{R2} \tag{2}$$

$$\text{for } -U_Z < U_C < U_{D1,2}: \quad i = 0 \tag{3}$$

wherein $U_{D1}$=the forward diode voltage of D1≈0.7 V $U_{D2}$=the forward diode voltage of Zener diode $D_2$≈0.7 V $U_Z$=the Zener voltage of Zener diode D2≈3.9 V. From this it follows that:

$$\left.\begin{array}{l} U_C > U_{D1,2} \\ U_C > 0.7 \end{array}\right\} i = \frac{U_C - 0.7}{R1} + \frac{U_C - 0.7}{R2} = \frac{(U_C - 0.7)}{R1//R2}$$

$$\left.\begin{array}{l} U_C < -U_Z \\ U_C < -3.9 \end{array}\right\} i = \frac{U_C + 3.9}{R2}$$

$$\left.\begin{array}{l} -U_Z < U_C < U_{D1,2} \\ -3.9 < U_C < 0.7 \end{array}\right\} i = 0$$

As, in addition, R2>R1, this means that when the voltage $U_C$ becomes positive, the integrator input current i begins earlier and rises more rapidly than if, conversely, $U_C$ becomes negative. A positive $U_C$, and hence positive i, means that the integrator output voltage $U_o$ is driven downwards, whereas a negative $U_C$ and i effect an increase in integrator output voltage in the positive direction. As the rate of the increase and decrase of the integrator output voltage is proportional to the input current i, this means that a positive $U_C$ causes the output voltage to decrease rapidly ($U_o$ becomes ≈0 in a one-quarter 135 c period at a maximally high UC). A (maximally) negative $U_C$ causes $U_o$ to increase only slowly, and approximately ten cycles of the 135 c signal are required to cause $U_o$ to increase to such an extent as to reach the threshold level of level detector 31, which e.g. may be a flip flop, and to cause the alarm to go off.

The result of this mechanism is that the alarm cannot go off in response to noise or to another spurious signal. Indeed, in the absence of a 135 c signal, the circuit may be driven fully with receiver noise and received noise and spurious signals, without the alarm being given. Therefore, a sensitivity adjustment in the form of an attenuator is unnecessary. The circuit will sound the alarm only if a 135 c signal appears which 1. has the correct phase relative to the synchronous switch 2. has a sufficiently high signal-to-noise ratio. Indeed, the detection criterion is not the signal level in an absolute sense, but the signal-to-noise ratio. The detection threshold is then determined by the detection threshold circuit, in particular the ratio R2/R1 and the Zener diode voltage $U_Z$.

Figure 10:
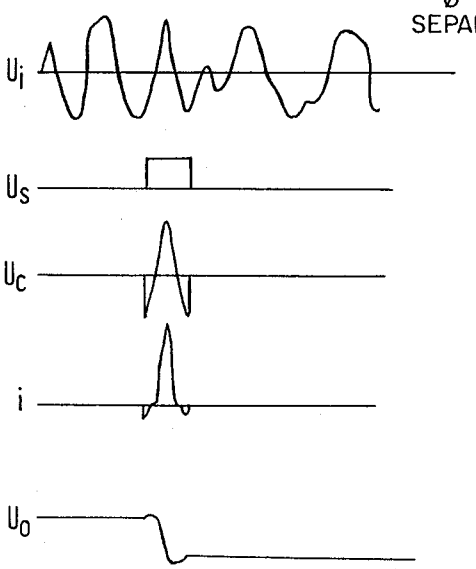
FIGS. 9 and 10 show some wave forms occurring in the circuit of FIG. 8.
Figure 9:
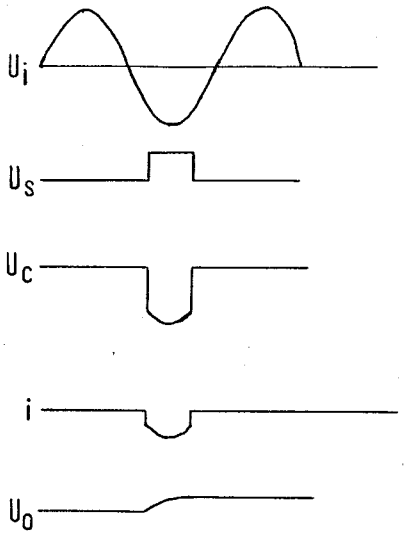

FIG. 9 shows the voltage and current forms upon reception of a 135 c signal. FIG. 10 shows the same for a random signal.

In the foregoing, a detection system is described, in which use was made of a frequency-modulated transmitted signal (the interrogation field), a responder with a frequency divider which divides the frequency received by a relatively high factor N, and a device capable of receiving the signal transmitted by the responder, and recognizing it by the frequency modulation.

It is also possible, however, to design a similar system in which, using the same responder, the interrogation field is not frequency-modulated, and detection is effected by different means. Such a system will be described hereinafter.

In such a system there is, accordingly, continuously an unmodulated interrogation field which, again, may have for example a frequency of 138 kc. The responder then sends back an unmodulated response signal which, for example, may again have a frequency of 17.25 kc.

Owing to the frequency division in the responder, however, the phase relation with the transmitted signal is lost, i.e., the 17.25 kc signal from the responder may have eight different phases relative to a 17.25 kc reference signal generated at the transmitter end. Furthermore, the transmitting and receiving coils also cause phase shifts, so that in practice all phase differences (between the responder signal and the reference signal) between 0° and 360° may occur.

If, however, a responder is present in the interrogation field and sends back a signal with a given phase, this phase will no longer be changed so long as the responder remains in the field. This property is utilized in the system to be described hereinafter to effect reliable detection.

For this purpose there is provided at the receiving end of the system a synchronous detection circuit based on four synchronous switches each controlled with a reference signal, the reference signals differing in phase from each other by 90°. The signal received from the responder is then always in phase with one of the four switches (with a deviation of no more than 45°). Each of the four switches is connected, via a detection threshold circuit, with an associated integrator of the kind shown in FIG. 8. The integrator outputs are connected to a common output via an OR gate.

Figure 11:
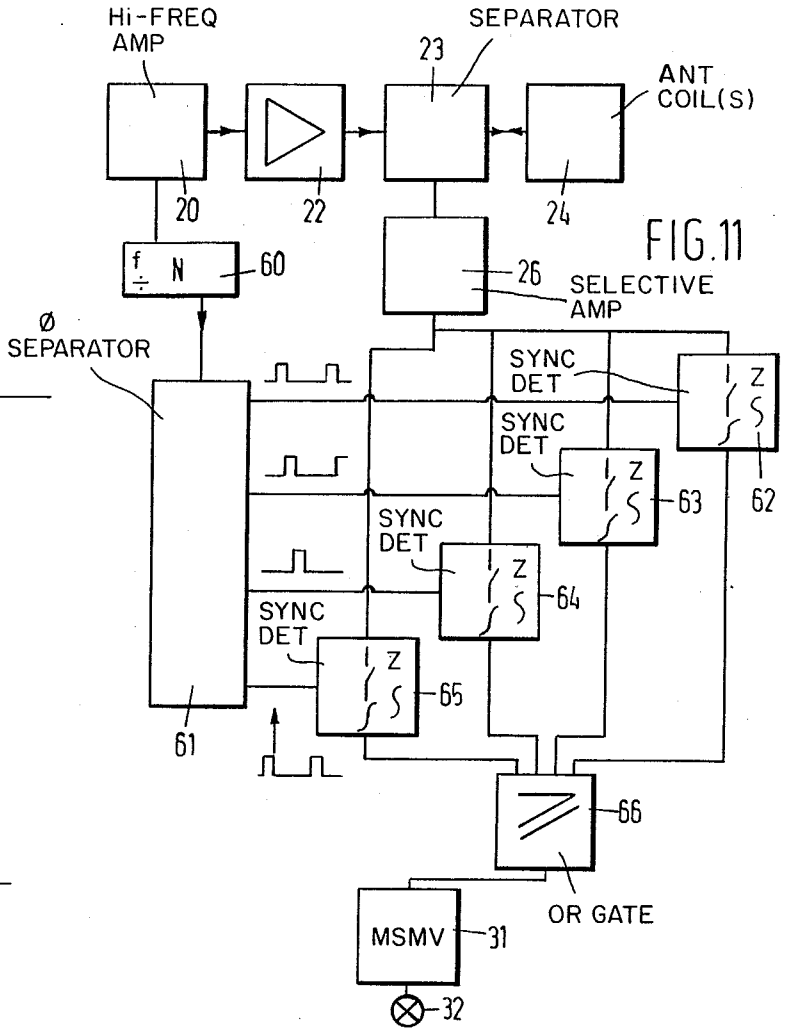
FIG. 11 shows a block diagram of a second variant of a system according to the invention.

FIG. 11 shows the basic diagram of such a system. Parts of FIG. 11 corresponding to parts of FIG. 4 are designated by the same reference numerals.

An oscillator 20 provides a signal having a frequency of, e.g. 138 kc, which is amplified by a power amplifier 22 and supplied by a duplexer or other separator 23 to one or more antenna coils 24. The signal from the oscillator 20 is also supplied to a frequency divider 60, dividing e.g. by eight. The output signal from the frequency divider is supplied to a phase separator 61 having four outputs. The signals generated as these outputs successively differ 90° in phase and respectively control circuits 62–65, each built up in the manner shown in FIG. 8. Connected to apparatus 23 is further a selective amplifier 26, to which the signal received by the antenna coils of a responder is supplied. The output signal from the selective amplifier is supplied to each of circuits 62–65. The outputs of circuits 62–65 are connected to an OR gate 66, the output of which may activate level-detector 31 (the detector being described on page 10) each time one of the circuits 62–65 generates an output signal.

A signal having a frequency differing from the reference signal has a continuously varying phase relative to the reference signal, and will not stay in one phase quadrant long enough to cause the output signal from the integrator of one of circuits 62–65 to increase sufficiently, and will accordingly fail to cause the alarm go off. If there is a slight difference in frequency, however, detection is still possible, so that, in practice, a detection band with a width of a few cycles is obtained.

It is noted that various modifications of the detection systems described are within the reach of those skilled in the art. Thus, for example, the systems described may be extended with a coding circuit in the responder and a code recognition circuit in the receiver. These and other modifications are considered to fall within the scope of the invention.

I claim:

1. In an electronic detection system, comprising:

transmitter means for generating an interrogation field, said transmitter means being coupled with at least one transmitting antenna coil;

responder means including a receiving coil for receiving a signal having a signal frequency and a transmitting coil for transmitting a signal in response to said interrogation field; and receiver-and-detector means coupled with at least one receiving antenna coil for receiving and further processing the signal transmitted by said responder means;

the improvement wherein said receiving coil and said transmitting coil of said responder means are arranged in parallel to each other, and said responder means comprises a frequency divider connected between said receiving coil and said transmitting coil and arranged to divide the signal frequency received by a factor of $N \geqq 4$.

2. A detection system according to claim 1, wherein the receiving coil and the transmitting coil of the responder means are jointly arranged on a single ferrite rod.

3. A detection system according to any one of claims 1 or 2, wherein the frequency divider is a divide-by-eight circuit.

4. A detection system according to claim 3, wherein the responder means comrpises a rectifying and smoothing circuit connected between the receiving coil and the frequency divider.

5. A detection system as claimed in claim 1 or 2, wherein the transmitter means comprises a high-frequency oscillator which, via at least one power amplifier, energizes the transmitting antenna coil and generates an output signal, and a modulation oscillator for frequency modulating the output from said high-frequency oscillator; and wherein the transmitting means includes a receiver portion having a synchronous detector, said modulation oscillator providing a reference signal to the synchronous detector of the receiver portion; the receiver-and-detector means comprising a filtering device selectively tuned to the frequency transmitted by the responder; said receiver portion including an FM demodulator connected to said synchronous detector and producing a demodulator output signal, said synchronous detector providing said demodulator output signal as a detector output if the demodulator output signal is sufficiently in phase with said reference signal provided to said synchronous detector by said modulation oscillator.

6. A detection system according to claim 5, wherein said synchronous detector comprises a synchronous switching device controlled by the reference signal and connected between a first terminal of an input to which the demodulator output signal is supplied and a parallel circuit comprising first and second branches, the first branch including a resistor and a diode, the second branch including a resistor and a Zener diode, said parallel circuit being further connected to a negative input of an operational amplifier connected as an integrator, the operational amplifier having an output which forms an output of the synchronous detector, and the operational amplifier having a positive input connected to a second terminal of said input.

7. A detection system according to claim 5, wherein the output of said synchronous detector is connected to a level detector which issues an energizing signal to an alarm signaling device as soon as the output signal of said synchronous detector reaches a set level.

8. A detection system according to claim 7, wherein said level detector is a monostable multivibrator.

9. A detection system according to any one of claims 1 or 2, wherein said transmitter means comprises a high-frequency oscillator which, via at least one power amplifier, energizes the transmitting antenna coil and generates a high-frequency output, and a frequency divider connected to said high-frequency oscillator for dividing the high-frequency output by said factor N by which the frequency is divided in said responder means to obtain a frequency divider output, the frequency divider output being supplied to a phase separator having four outputs carrying phase separator signals differing by 90° in phase relative to each other, said phase separator signals being supplied as reference signals to a synchronous detection device of the receiver-and-detector means.

10. A detection system as claimed in claim 9, wherein the synchornous detection device comprises four synchoronous detectors having outputs, each of the four synchronous detectors being supplied with one of the output signals of said phase separator and with the signal received by the receiving coil of said responder means, the outputs of said synchronous detectors being connected to an OR gate having an output which is connected to a level detector.

11. A detection system as claimed in claim 10, wherein said level detector is a monostable multivibrator with an adjustable detection level.

12. A detection system as claimed in any one of claims 1 or 2, wherein the transmitting antenna coil is also the receiving antenna coil with a separator being provided for coupling with the transmitter means and the receiver-and-detector means, respectively.

13. A detection system as claimed in claim 12, wherein said separator and at least one transmitting-/receiving antenna coil form an antenna circuit, the transmitting/receiving antenna coil and a first capacitor forming a first LC circuit capable of resonating to the transmission frequency, and wherein a second LC circuit is cascade-connected to said first LC circuit, said second LC circuit being capable of resonating to the frequency transmitted by said responder means, said second LC circuit including a second coil, a second capacitor, and at least one transmitting/receiving antenna coil, and further including a third capacitor which, together with said second coil, forms a circuit resonating to the transmission frequency.

14. A detection system as claimed in claim 13, wherein an antenna circuit symmetrical relative to ground is formed by duplication of said second coil and said second and third capacitors, said antenna circuit being energized via a phase separator and two associated amplifiers by two signals differing by 180° in phase relative to each other.

15. A detection system according to claim 12, wherein two transmitting/receiving antenna coils are disposed substantially at right angles to each other, said coils being energized via associated antenna circuits, with signals being phase-shifted through 90° relative to each other for generating a rotary field.

16. A detection system as claimed in claim 6 wherein the output of said synchronous detector is connected to a level detector which issues an energizing signal to an alarm signalling device as soon as the output signal of said synchronous detector reaches a set level.

17. A detection system as claimed in claim 13, wherein an antenna circuit symmetrical relative to ground is formed by duplication of said second coil and said second and third capacitors, said antenna circuit being energized via a phase separator and two associated amplifiers by two signals differing by 180° in phase relative to each other.

18. A detection system as claimed in claim 13, wherein two transmitting/receiving antenna coils are disposed substantially at right angles to each other, said coils being energized via associated antenna circuits, with signals being phase-shifted through 90° relative to each other for generating a rotary field.

19. A detection system as claimed in claim 14 wherein two transmitting/receiving antenna coils are disposed substantially at right angles to each other, said coils being energized via associated antenna circuits, with signals being phase-shifted through 90° relative to each other for generating a rotary field.

20. A detection system according to any one of claims 1 or 2, wherein the responder means comprises a rectifying and smoothing circuit connected between the receiving coil and the frequency divider.

* * * * *